US008303367B2

(12) United States Patent
English

(10) Patent No.: US 8,303,367 B2
(45) Date of Patent: Nov. 6, 2012

(54) FLYING SHARK

(75) Inventor: Blake English, Claremont, CA (US)

(73) Assignee: William Mark Corporation, Claremont, CA (US)

( * ) Notice: Subject to any disclaimer, the term of this patent is extended or adjusted under 35 U.S.C. 154(b) by 0 days.

(21) Appl. No.: 13/287,020

(22) Filed: Nov. 1, 2011

(65) Prior Publication Data

US 2012/0045961 A1 Feb. 23, 2012

Related U.S. Application Data

(62) Division of application No. PCT/US2010/055574, filed on Nov. 5, 2010.

(60) Provisional application No. 61/259,071, filed on Nov. 6, 2009.

(51) Int. Cl.
*A63H 3/06* (2006.01)

(52) U.S. Cl. ..... 446/225; 446/220; 446/456; 244/24; 244/31

(58) Field of Classification Search ..... 446/220, 446/225, 223, 221, 226, 153–155, 454, 456, 446/486, 176; 244/24–33, 96, 97
See application file for complete search history.

(56) References Cited

U.S. PATENT DOCUMENTS 1,561,721 A * 11/1925 Humphrey ..... 446/225
2,763,958 A * 9/1956 Lemelson ..... 446/225
3,009,670 A * 11/1961 Williams et al. ..... 244/46
3,589,058 A * 6/1971 Labat ..... 446/179
4,038,777 A * 8/1977 Schwartz ..... 446/225
4,077,588 A * 3/1978 Hurst ..... 244/31
4,204,656 A * 5/1980 Seward, III ..... 244/30
4,221,351 A * 9/1980 Holland, Jr. ..... 244/153 R
4,272,042 A 6/1981 Slater
4,465,251 A * 8/1984 Newbold ..... 244/155 R
4,547,167 A * 10/1985 Bergmann ..... 446/226
4,714,444 A * 12/1987 Rendel ..... 446/61
4,752,271 A * 6/1988 Reilly et al. ..... 446/225
4,891,029 A * 1/1990 Hutchinson ..... 446/225
4,931,028 A * 6/1990 Jaeger et al. ..... 446/225
4,946,415 A * 8/1990 Huang ..... 446/225
4,964,598 A 10/1990 Berejik et al.
5,011,100 A * 4/1991 Gerstein ..... 244/153 R
5,194,029 A * 3/1993 Kinoshita ..... 244/28
5,240,206 A 8/1993 Omiya
5,344,357 A 9/1994 Lyczek
5,429,542 A * 7/1995 Britt, Jr. ..... 446/225
5,603,277 A * 2/1997 Webb ..... 114/39.25
5,906,335 A 5/1999 Thompson
(Continued)

OTHER PUBLICATIONS

"Remote Controlled Helium Filled Balloon", www.americantoning.com/balloon/BIGUFO.JPG.
"Festo Flying Animals" (URLs only), www.youtube.com/watch?v=UxPzodKQays; www.youtube.com/watch?v=F_citFkSNtk; http://www.youtube.com/watch?v=jPGgl5VH5go.
"SkyTec Blimp", www.raidtech.com/skaiexairshs.html, p. 4.

*Primary Examiner* — Gene Kim
*Assistant Examiner* — Urszula M Cegielnik
(74) *Attorney, Agent, or Firm* — Fish & Associates, PC

(57) ABSTRACT

A neutrally buoyant flying toy has a tail fin assembly and a movable weight element that are configured such that the toy moves forward and can be steered left and right by controlled motion of the tail fin, and such that the toy ascends or descends by controlled motion of the weight element. Most preferably, the toy is configured as a fish and is remote controlled.

16 Claims, 3 Drawing Sheets

U.S. PATENT DOCUMENTS 6,361,395 B1 * 3/2002 Pacza ..... 446/368
6,520,824 B1 * 2/2003 Caroselli ..... 446/58
6,848,647 B2 * 2/2005 Albrecht ..... 244/2
6,877,692 B2 * 4/2005 Liu ..... 244/22
6,991,510 B2 * 1/2006 Nan ..... 446/220
7,356,390 B2 * 4/2008 Knoblach et al. ..... 244/31
7,780,498 B1 * 8/2010 Caspi et al. ..... 446/454
2007/0063099 A1 * 3/2007 Holloman, Jr. ..... 244/117 R
2007/0161322 A1 * 7/2007 Carmon ..... 446/220
2008/0087762 A1 * 4/2008 Holloman et al. ..... 244/30

* cited by examiner

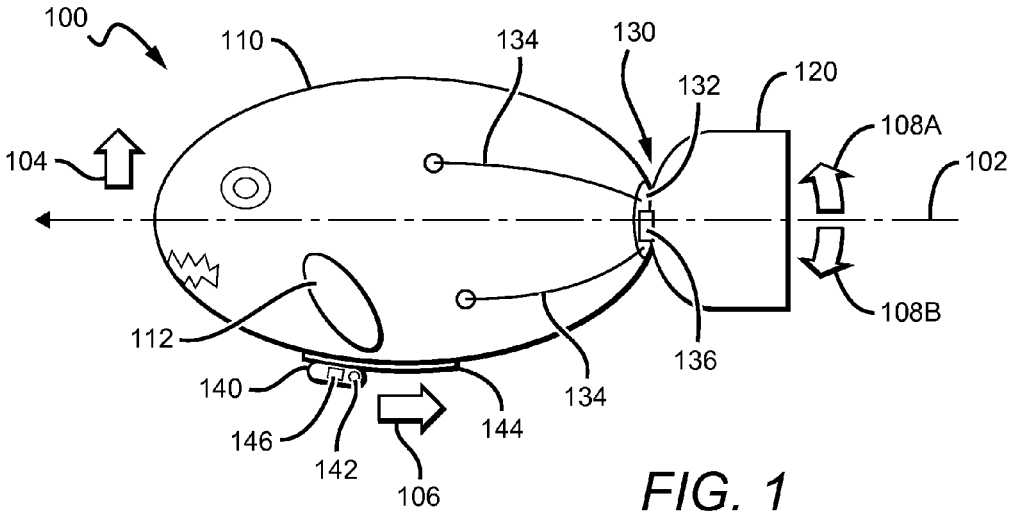
FIG. 1
FIG. 2
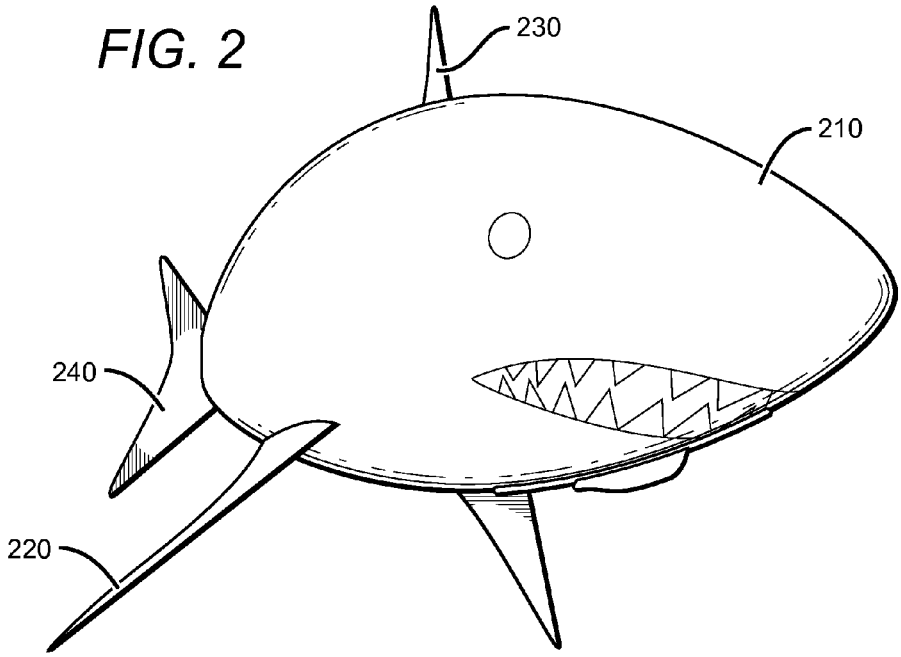

FIG. 3A
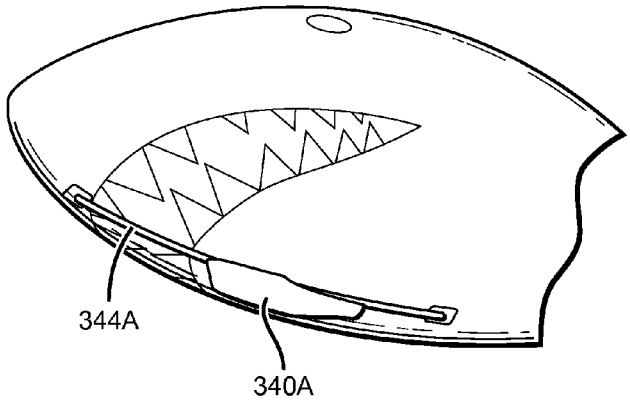
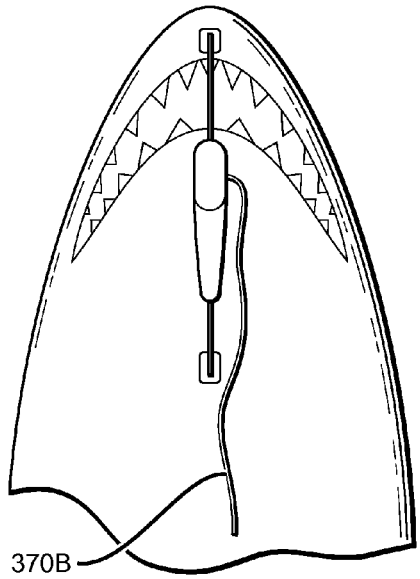
FIG. 3B
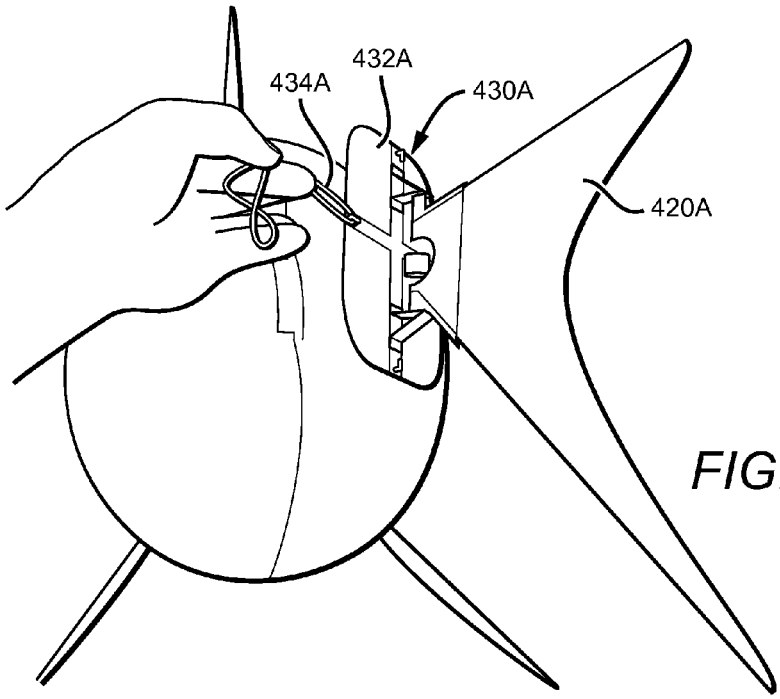
FIG. 4A

FIG. 4B
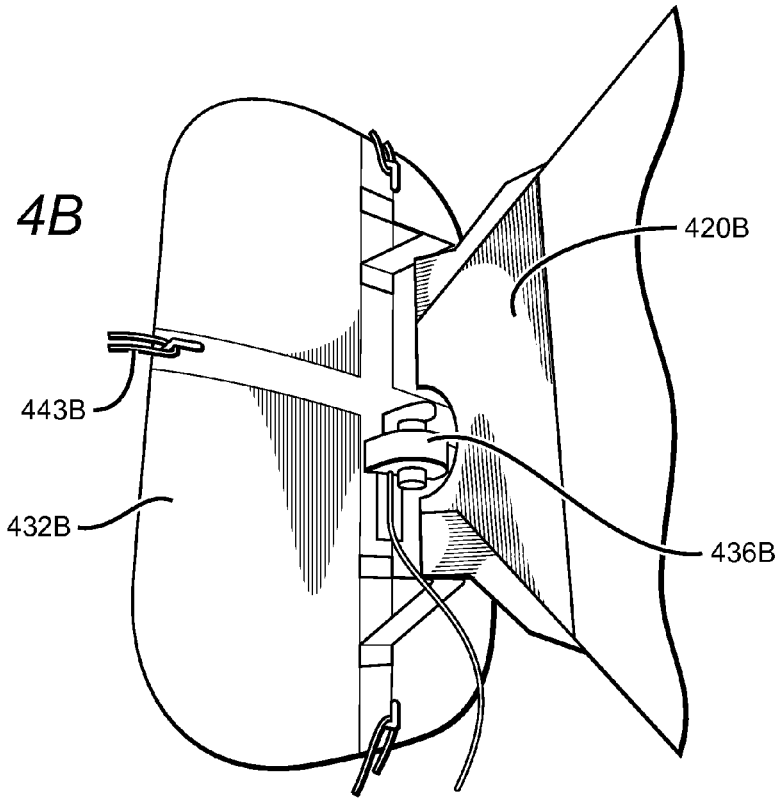
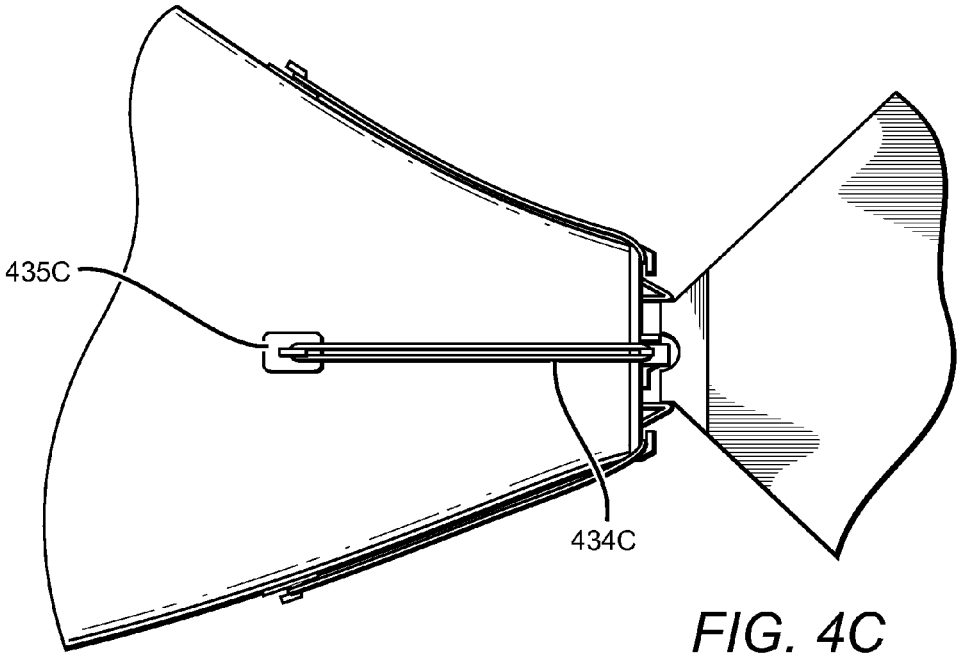
FIG. 4C

FLYING SHARK

This application is a divisional of International Application No. PCT/US10/55574, filed Nov. 5, 2010 which claims priority to U.S. Provisional Application No. 61/259,071, filed Nov. 6, 2009, both of which are incorporated herein by reference in their entirety.

FIELD OF THE INVENTION

The field of the invention is flying toys, and especially remote control neutrally buoyant flying toys.

BACKGROUND OF THE INVENTION

Neutrally buoyant flying toys have enjoyed considerably popularity. For example, as can be seen from http://www.americantoning.com/balloon/index7.html, a UFO-shaped toy has two small and independently controlled motors to so provide a blimp-like control. Similarly, a remote control shark is shown in http://www.raidentech.com/skaiexairshs.html where a small propeller assembly provides propulsion and direction of the flying toy. Likewise, as taught in U.S. Pat. No. 5,240,206, a blimp-like flying toy has multiple propellers to provide propulsion and directional control. While such mechanisms are conceptually simple, they are most suitable for toys that imitate a flying object that has already a propeller-based propulsion system (e.g., blimp, plane, etc.). However, where the flying toy is configured as a fish or other swimming animal, propeller-based propulsion is less than realistic and therefore often undesirable.

To overcome such disadvantages, a flying toy is shaped as a fish and has a reciprocating tail fin that provides forward motion to the toy as described in U.S. Pat. No. 5,194,029. While such mechanism is significantly more realistic, several disadvantages remain. Among other things, directional control (lateral and up/down) is not possible using such fin mechanism. A significantly improved flying toy is known from Festo's air toys (e.g., flying penguin, flying ray, flying jelly fish, as can be seen from www.youtube.com/watch?v=UxPzodKQays, www.youtube.com/watch?v=F_citFkSNtk, http://www.youtube.com/watch?v=jPGgl5VH5go). Here multiple control elements contort substantially the entire body of a flying toy to so produce astoundingly realistic flight motion. However, such devices are hardly considered toys as the manufacture is extremely expensive and requires highly sophisticated personnel.

Thus, even though there are numerous devices and methods for neutrally buoyant flying toys known in the art, all or almost all of them suffer from various disadvantages. Consequently, there is still a need to provide improved neutrally buoyant flying toys.

SUMMARY OF THE INVENTION

The inventors have discovered that numerous flying toys can be manufactured in a simple and effective manner, wherein flight of the toys can be controlled in both horizontal and vertical direction. Most preferably, such flying toys simulate with a high degree of realism movement of a fish in its natural habitat.

In one preferred aspect of the inventive subject matter, a flying toy includes a body portion that is filled with a lighter-than-air gas and that has a volume sufficient to provide neutral buoyancy to the toy. A moving surface is coupled to a first actuator and the body portion, wherein the first actuator allows moving of the surface at variable and different angles relative to a forward directional axis of the toy. A second actuator is further coupled to the body portion and moves a weight element in parallel or perpendicular direction relative to the forward directional axis such that the movement of the weight element changes pitch of the toy in flight to so control ascent or descent of the flying toy.

Most preferably, the moving surface is coupled to a preferably removable tail assembly, which is in turn preferably coupled to the body portion via an elastic element in a manner that allows application of a compressive force to the body. In further preferred aspects, the first actuator is also coupled to the tail assembly. While not limiting to the inventive subject matter, it is typically preferred that the weight element is coupled to the body portion via a rail or I-beam having a curvature, which is most typically the same as that of the body portion where the rail or I-beam is coupled to the body portion. It is also preferred that the weight element further comprises removable ballast elements.

While numerous shapes are deemed suitable for the flying toy, it is generally preferred that the flying toy has the shape of a fish (e.g., shark, whale, clown fish), and that the moving surface is configured as tail of the fish. Additionally, it is preferred that the body portion includes or is coupled to at least one stabilizing air foil (e.g., dorsal fin, pectoral fins, etc), and that first and second actuators are controllable by an RF remote control system.

Therefore, the inventors also contemplate a tail fin assembly for a flying toy, wherein the assembly comprises a base plate having an actuator that is coupled to a moving surface such that the moving surface is movable at variable and different angles relative to a forward directional axis of the toy. It is further preferred that an elastic element is coupled to the base plate and configured to allow reversible coupling of the tail fin assembly to an inflated and compressible body portion the toy.

In especially preferred aspects, the actuator is a remote control servo, and the moving surface is configured as a fin and formed from a tail portion that is filled with a lighter-than-air gas. Most preferably, the base plate and toy are configured such as to allow application of a compressive force to the body via the elastic element, that the toy is configured as a fish, and that the moving surface is configured as a tail fin.

In yet another aspect of the inventive subject matter, a neutrally buoyant flying toy includes a body portion that is at least partially filled with a lighter-than-air gas in an amount effective to render the toy neutrally buoyant. An actuator is then coupled to the body portion and configured to allow movement of a weight element parallel or perpendicular to a forward directional axis of the toy such that movement of the weight element changes pitch of the toy relative to the forward directional axis while the toy is flying to thereby control ascent or descent of the flying toy.

In further preferred aspects, the weight element further comprises removable ballast elements. Typically, the actuator is configured to allow movement of the weight element parallel to the forward directional axis of the toy when the toy has a moving surface that is configured to move side-to-side for forward propulsion of the toy. In such configurations, it is generally preferred that the weight element is coupled to the body portion via a rail or I-beam having a curvature that is substantially the same as that of the body portion where the rail or I-beam is coupled to the body portion. While not limiting to the inventive subject matter, it is preferred that the toy is configured as a shark, and that the weight element is configured as a remora.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1 is a schematic illustration of an exemplary flying toy according to the inventive subject matter.

FIG. 2 is a photograph of an exemplary flying toy according to the inventive subject matter.

FIGS. 3A-3B are photographs showing respective detail views of an exemplary weight element and guide structure according to the inventive subject matter.

FIGS. 4A-4C are photographs showing respective detail views of an exemplary tail fin assembly according to the inventive subject matter.

DETAILED DESCRIPTION

According to the present invention, various neutrally buoyant flying toys, and especially remote controlled neutrally buoyant flying toys are presented that have a mode of propulsion in which at least one moving surface (most typically a tail fin) of the toy oscillates in a controlled manner to thereby provide forward and lateral motion control. The moving surface is preferably removably coupled to the inflated and compressible body portion of the toy by an elastic element that exerts compressive force to the body portion, which assists in maintaining sufficient rigidity of the body portion where the toy is inflated with a lighter-than-air (LTA) gas. In particularly preferred aspects, the flying toy also has a movable weight element that controls the pitch of the flying toy to thereby allow for controlled ascent or descent of the flying toy.

FIG. 1 is a schematic illustration of an exemplary flying toy 100 that is in the shape of a fish. Toy 100 has a body portion 110 and a moving surface 120 for forward propulsion and lateral motion control in the shape of a tail fin. The moving surface 120 is coupled to the tail fin assembly 130. Weight element 140 is movably coupled to the body portion 110 via I-beam 144 for adjustment of pitch and vertical motion control. In preferred embodiments, tail fin assembly 130 is coupled to the LTA gas inflated and compressible body portion 110 via elastic elements 134. It should be appreciated that the elastic elements not only allow for simple attachment and removal of the tail fin assembly, but also assist in maintaining rigidity of the body portion, even when some of the LTA gas has escaped from the body portion. Stabilizing airfoils 112 may be added to the toy as decorative and/or functional elements to improve lateral and/or vertical motion control.

In further preferred aspects, the toy is propelled by oscillating movement of the moving surface 120 about the forward directional axis 102 of the toy as indicated by arrows 108A and 108B. Lateral control (i.e., steering to the left and right) is achieved by moving surface 120 at variable and different angles. For example, where a sharp turn is desired, the surface is moved in repeated manner only in the direction as indicated by angle 108A, wherein the surface 120 may return to neutral position or may move from a first to a second angle. On the other hand, where a shallow turn is desired, the surface 120 may move from side to side at angles 108A and 108B, where 108A is consistently larger than 108B. Where it is desired that the toy moves straight ahead, the surface 120 may move from side to side at angles 108A and 108B, where 108A and 108B are the same. Therefore, it should be appreciated that the moving surface 120 will not only propel the toy, but also allow for lateral motion control. Movement of the surface 120 is typically effected by a first actuator 136 (e.g., servo drive) that is controlled by a remote control circuitry as is well known in the art. For example, the left-right steering mechanism of a commercially available remote control car may be used to control movement of the surface 120. It is generally preferred that the actuator 136 is coupled to a base plate 132 of the tail fin assembly 130, which is coupled to the body portion 110 via one or more elastic elements 134 (e.g., rubber bands).

Similarly, the weight element 140 may be moved along a guide structure, for example, plastic I-beam 144 using a second actuator 146 (e.g., servo drive) that is controlled by a remote control circuitry as is well known in the art. For example, a forward-backward drive mechanism of a commercially available remote control car may be used to control movement of the weight element 140. It is generally preferred that the guide element (here: I-beam 144) is substantially parallel (e.g., within 30 degrees, more typically 15 degrees deviation) to the forward directional axis 102 of the toy, and that the guide element is coupled to the body portion relative to the center of gravity of the toy such that movement of the weight element will change the pitch of the toy relative to the forward directional axis of the toy. Exemplary movement of the weight element 140 along I-beam 144 is illustrated by arrow 106, resulting in an upwards pitch of the toy 100 as indicated by arrow 104. Continued oscillating movement of the surface 120 at elevated pitch will result in upwards motion of the toy. Consequently, it should be appreciated that that movement of the weight element changes pitch of the toy relative to the forward directional axis while the toy is flying to thereby control ascent or descent of the flying toy. To further compensate for potential loss of LTA gas or adjust to local altitude, it is preferred that the weight element further includes a compartment that contains removable ballast elements 142 (e.g., lead shot).

For example, in an especially preferred aspect of the inventive subject matter, the flying toy is fabricated from MYLAR™ (biaxially-oriented polyethylene terephthalate) film or other mechanically resilient material and shaped in the form of a shark. The toy is preferably shaped such that the toy is inflatable to neutral buoyancy with an LTA gas. Therefore, contemplated toys will most typically have a minimum length of 30 cm, more typically at least 50 cm, and most typically at least 80 cm, and a height and thickness of at least 10 cm, more typically at least 25 cm, and most typically at least 30 cm. Viewed from a different perspective, contemplated toys will have an inner volume of at least 5 liters, more typically at least 10 liters, and most typically at least 25 liters, but typically less than 500 liters, more typically less than 300 liters, and most typically less than 200 liters. Thus, the weight of the toy will typically not exceed 200 g (without LTA gas), more typically not exceed 120 g, and most typically not exceed 80 g.

Where desired, at least some portions of the toy may be reinforced with thicker material, or other reinforcing materials (e.g., carbon fiber). It is further generally preferred that the flying toy will have one or more (stabilizing) air foils that may or may not serve as control surfaces. Such stabilizing air foils are preferably shaped as fins, which may or may not be inflated, and which may or may not have a profile that is effective to provide lift. While not limiting to the inventive subject matter, it is also generally preferred that at least one of the air foils is a fixed surface (i.e., is not actuated by an actuator) while at least one other control surface is a moving surface (i.e., actuated by an actuator) that provides propulsion and/or directional control. Therefore, it should be noted that the fixed surface may act as a fixed wing to guide the toy through the air, while the moving surface may provide the propulsion.

In one particularly preferred aspect, the moving surface is configured as the vertical tail fin of a shark or other fish, and is actuated by a servo motor such that the moving surface will be able to move to either side of the flying toy with the same or different amplitude relative to the forward directional axis. Consequently, where the fin moves in asymmetrical oscillation, lateral movement can be controlled (e.g., by limiting excursion of the fin to 30 degrees to the left and limiting excursion of the fin to 50 degrees to the right). Of course, it should be appreciated that such movement may be distributed across additional surfaces (which may or may not be formed as a fin) to increase realism of motion. There are numerous manners of controlling side-to-side motion of a fin in a toy known in the art, and all of those are deemed suitable for use herein. For example, suitable mechanisms include servo controls of R/C toys, which may be coupled to wires or otherwise resilient implements to force movement of the fin. Alternatively, the fin may be directly coupled to a servo. Similarly, the tail fin may also be configured as a fluke of a whale, and the motion of the fluke will then be up and down relative to the forward directional axis. Thus, it should be appreciated that the tail fin motion in preferred aspects is not controlled by a reciprocating mechanism that only provides the same amplitude of the moving surface relative to the forward directional axis. In contrast, it should be appreciated that the actuator that controls movement of the moving surface is configured to allow a user to control the amplitude of movement of the moving surface in either direction of the forward directional axis. Most typically, such control is implemented with a remote control servo motor similar or identical to those used in the steering of a remote control car.

Additionally, it is generally preferred that the neutrally buoyant flying toy also includes a second mechanism that is capable of shifting the pitch of the toy with respect to the forward directional axis while the toy is in the air. Thus, and especially where the toy has additional (fixed) control surfaces, the change in pitch of the toy will result in the toy flying upwards or downwards. Particularly preferred second mechanisms include those in which a weight is moved along a guide structure that is preferably parallel to the forward directional axis. There are numerous guide structures known in the art, and suitable guide structures include I-beams, flat rails, snake gears, rack-and-pinion gears, etc. the weight element is then preferably moved by a (servo)motor driven mechanism, including a wheel, a crank, etc, that allows relative movement of the weight element along the guide structure. In particularly preferred aspects, the guide element has a curvature that follows the curvature of the body portion of the toy. Alternatively, however, the guide element may also be configured as an at least partially external element that is coupled to the body portion. However, numerous other mechanisms are also deemed suitable and include shifting of a fluid weight (e.g., liquid or shot), partial rotation of an asymmetrically balanced disk, etc. In further contemplated aspects, it should also be recognized that such second mechanism may be used to compensate for the gradual loss in buoyancy of helium-filled toys as with loss of buoyancy the pitch can be changed to an upward pitch, which provides the upward vector in forward flight. Alternatively, or additionally, optional and removal ballast elements may be included to compensate for loss of buoyancy (e.g., due to loss of LTA gas or high-altitude use). Where the tail fin is configured as the fluke of a whale, it should be appreciated that the second mechanism will be need to be adapted to the up-and-down motion of the fluke. For example, vertical motion control can be achieved by disposing the guide element in perpendicular or angled orientation relative to the forward directional axis of the toy and such that the guide element is coupled to the body portion relative to the center of gravity of the toy to allow change of the pitch of the toy relative to the forward directional axis of the toy.

FIGS. 2-4C are photographs of exemplary embodiments of the inventive subject matter where the flying toy is configured as a shark or a clown fish. More specifically, FIG. 2 depicts a neutrally buoyant flying toy that is configured in the shape of a shark, where the body portion 210 is a helium filled MYLAR balloon that has two pectoral stabilizing fins 220 and a single dorsal stabilizing fin 230. Tail fin 240 is only partially visible. FIG. 3A is a detail view of a weight element that is configured as a remora (suckerfish) 340A that is movably coupled to I-beam 344A. FIG. 3B depicts another detail view of the weight element in which the power cable 370B to the actuator is more clearly visible. It should be noted, however, that the power cable may also be internally routed through the body portion, or be printed as flexible trace onto the outside of the body portion (which may or may not provide the power to two portions of the I-beam that are electrically insulated from each other).

FIG. 4A depicts exemplary tail fin assembly 430A with base plate 432A and moving surface 420A. Elastic element 434A is shown detached from the body portion. FIG. 4B is a closer view of the tail fin assembly from which it can be seen how elastic elements 443B are coupled to the base plate 432B. Actuator 436B is also coupled to the base plate and directly drives the rigid base of moving surface 420B. FIG. 4C depicts an exemplary manner of coupling the elastic element 434C to an (preferably adhesive) anchor 435C on the body portion of the toy. As can be readily seen, the base plate and the end of the body portion are configured to allow engagement and retention of the base plate onto the body portion using the compressive force of the elastic elements.

While not limiting to the inventive subject matter, it is generally preferred that the flying toy is remote controlled such that (a) control of the reciprocating fin provides forward motion and allows steering the toy to the left or right of the forward directional axis, and (b) control of a second mechanism changes the pitch of the toy to so allow for up- and downward flight (and also to compensate for loss in buoyancy). As noted before, there are numerous remote control devices and systems known in the art, and all of them are deemed suitable for use herein. It should be noted that the remote control receiver may be coupled to any portion of the flying toy. However, it is generally preferred that the receiver and associated power supply are either coupled to the base plate in the tail fin assembly, or advantageously be included in the weight element. Of course, if suitable, the receiver and/or associated power supply may also be disposed inside the body portion. In less preferred aspects of the inventive subject matter, the flying toy may also include a control unit that uses a (mechanically or electronically) preprogrammed pattern, or may include one or more sensors. The signals generated from the sensor(s) may then be used to move the flying toy in a predetermined space in a predetermined path or in a random path.

Of course, it should also be appreciated that the toys according to the inventive subject matter may be modified in numerous manners without departing from the inventive concept presented herein. For example, while it is generally preferred that the toy is configured as a fish and that the moving surface is configured as a fin, contemplated toys may also be configured as other animals, and especially those that move by undulating motion (e.g., reptiles such as snakes, alligators, etc., eels, etc.), as UFOs, airships, etc. Consequently, toys according to the inventive subject matter may include additional propulsion mechanisms such as propellers (which may or may not be operational), compressed air jets, etc. Similarly, while it is generally preferred that the toys will have only one moving surface (typically a fin), multiple moving surfaces are also deemed suitable, which may move in a coordinated manner, or independently from each other. Moreover, the moving surface may be segmented to so allow for a compound motion, which is preferably coordinated among the segments. Of course, it should be noted that the moving surface may be inflated or non-inflated.

The energy demand of the toy is typically met by use of an on-board battery, however, it is contemplated that at least part of the energy may also be provided by photoelectric or photochemical cells that are coupled to the toy or form part of the toy. Still further, it is contemplated that while the toy may be primarily used for enjoyment, various other uses are also deemed suitable and especially include surveillance operations. Thus, additional components may be included such as transceivers, cameras, microphones, speakers, etc.

Most preferably, the flying toy will include a body portion to which a tail fin assembly is removably coupled, wherein the tail fin assembly preferably comprises a relatively rigid base plate (e.g., polyethylene or polycarbonate plate, 1-2 mm thickness) upon which the movable surface and the actuator moving the surface is installed. Most preferably, the RC circuitry for at least the movable surface (but preferably also the movable weight element) is also disposed on the tail fin assembly. In still further preferred aspects, the tail fin assembly is coupled to the body portion of the toy via elastic elements to allow facile installation and removal of the assembly. Moreover, it should be noted that the elastic elements also provide a mechanism to apply pressure to the body portion in an amount sufficient to maintain sufficient rigidity of the inflated and compressible body portion of the toy. Alternatively, the base plate may be integral with the body portion. In such case, external elastic elements may be provided to maintain sufficient rigidity of the inflated and compressible body portion of the toy. The term "compressible" as used herein refers to the ability to be compressed with moderate manual force while containing the LTA gas. For example, a commercially available helium filled MYLAR™ balloon is considered compressible under the scope of the above definition.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A flying toy, comprising:

a body portion that is configured to be inflatable by a lighter-than-air gas to thereby form an inflated body that is compressible by an elastic element, wherein the body portion has a volume sufficient to provide neutral buoyancy to the toy when the body portion is inflated with the lighter-than-air gas, and wherein the body portion is formed from a polymeric film;

a tail assembly that is coupled to the body portion by the elastic element, wherein the tail assembly, the body portion, and the elastic element are configured such that the elastic element assists, via exertion of a compressive force to the body portion, in maintaining sufficient rigidity of the body portion for propulsion by a moving surface when the toy is inflated with the lighter-than-air gas;

wherein the moving surface that is coupled via a first actuator and the tail assembly to the body portion, wherein the first actuator is coupled to the tail assembly, and wherein the first actuator is configured such that the moving surface is reciprocally movable by the first actuator at variable and different angles relative to a forward directional axis of the toy to thereby provide propulsion to the toy;

a second actuator coupled to the body portion via a guide element that extends in a parallel or perpendicular direction relative to the forward directional axis, and wherein the second actuator is configured to allow movement of a weight element by the second actuator in parallel or perpendicular direction relative to the forward directional axis; and wherein the weight element and guide element are coupled to the body portion such that the movement of the weight element changes pitch of the toy while the toy is flying to thereby allow for controlled ascent or descent of the flying toy.

2. The toy of claim 1 wherein the moving surface is configured as a fish fin.

3. The toy of claim 1 wherein the guide element is configured as a rail or I-beam and has a curvature.

4. The toy of claim 3 wherein the curvature is substantially the same as that of the body portion where the rail or I-beam is coupled to the body portion.

5. The toy of claim 3 wherein the weight element further comprises removable ballast elements.

6. The toy of claim 1 wherein the flying toy has a shape of a fish, and wherein the moving surface is configured as tail of the fish.

7. The toy of claim 1 wherein the body portion comprises or is coupled to at least one stabilizing air foil.

8. The toy of claim 1 wherein first and second actuators are controllable by an RF remote control system.

9. A tail fin assembly for a flying toy having a body portion that is configured to be inflatable by a lighter-than-air gas to thereby form an inflated body that is compressible by an elastic element, and wherein the body portion has an anchor element and is formed from a polymeric film, the tail fin assembly comprising:

a base plate comprising an actuator that is coupled to a moving surface such that the moving surface is reciprocally movable by the actuator at variable and different angles relative to a forward directional axis of the toy;

an elastic element coupled to the base plate and configured to compressibly couple the tail fin assembly via the anchor element on the body portion to the inflated and compressible body portion of the toy;

wherein the tail fin assembly, the body portion, and the elastic element are configured such that the elastic element assists, via exertion of a compressive force to the body portion, in maintaining sufficient rigidity of the body portion for propulsion by the moving surface when the toy is inflated with the lighter-than-air gas; and wherein the base plate and toy are configured such as to allow application of a compressive force to the body via the elastic element.

10. The flying toy of claim 9 wherein the actuator is a remote control servo.

11. The flying toy of claim 9 wherein the moving surface is configured as a fin and formed from a tail portion that is filled with a lighter-than-air gas.

12. The flying toy of claim 9 wherein the toy is configured as a fish, and wherein the moving surface is configured as a tail fin.

13. A neutrally buoyant flying toy, comprising a body portion that is configured to be inflatable by a lighter-than-air gas in an amount effective to render the toy neutrally buoyant to thereby form an inflated body that is compressible by an elastic element;

an actuator that is coupled to the body portion via a guide element that extends in a parallel or perpendicular direction relative to the forward directional axis;

wherein the actuator is configured to allow movement of a weight element along the guide element by the actuator in parallel or perpendicular direction relative to a forward directional axis of the toy such that movement of the weight element changes pitch of the toy relative to the forward directional axis while the toy is flying to thereby control ascent or descent of the flying toy;

wherein the elastic element is configured such that the elastic element assists, via exertion of a compressive force to the body portion, in maintaining sufficient rigidity of the body portion for propulsion by a moving surface that is coupled to the body portion when the toy is inflated with the lighter-than-air gas; and wherein the weight element further comprises removable ballast elements.

14. The flying toy of claim 13 wherein the actuator is configured to allow movement of the weight element parallel to the forward directional axis of the toy when the moving surface is configured to move side-to-side for forward propulsion of the toy.

15. The flying toy of claim 13 wherein the guide element is configured as a rail or I-beam and has a curvature that is substantially the same as that of the body portion where the rail or I-beam is coupled to the body portion.

16. The flying toy of claim 13 wherein the toy is configured as a shark, and wherein the weight element is configured as a remora.

* * * * *